US010527987B1

(12) United States Patent
Kawaguchi

(10) Patent No.: US 10,527,987 B1
(45) Date of Patent: Jan. 7, 2020

(54) FIXING BELT, FIXING DEVICE, AND IMAGE FORMING APPARATUS

(71) Applicant: KYOCERA Document Solutions Inc., Osaka (JP)

(72) Inventor: Kotatsu Kawaguchi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/444,067

(22) Filed: Jun. 18, 2019

(30) Foreign Application Priority Data

Jun. 21, 2018 (JP) ..... 2018-118190

(51) Int. Cl.
*G03G 15/20* (2006.01)

(52) U.S. Cl.
CPC ..... *G03G 15/2053* (2013.01); *G03G 15/2025* (2013.01); *G03G 15/2064* (2013.01); *G03G 2215/2003* (2013.01); *G03G 2215/2009* (2013.01); *G03G 2215/2016* (2013.01)

(58) Field of Classification Search
CPC ..... G03G 15/2025; G03G 15/2053; G03G 15/2064; G03G 2215/2003; G03G 2215/2009; G03G 2215/2016
See application file for complete search history.

(56) References Cited

U.S. PATENT DOCUMENTS 6,144,832 A * 11/2000 Nimura ..... G03G 15/206 271/119
6,456,819 B1 * 9/2002 Abe ..... G03G 15/2064 219/216
6,636,709 B2 * 10/2003 Furukawa ..... G03G 15/2039 399/329
8,909,116 B2 * 12/2014 Ohtsu ..... G03G 15/206 399/329
10,365,596 B1 * 7/2019 Tanaka ..... G03G 15/2053
2006/0269334 A1 * 11/2006 Takahashi ..... G03G 15/2064 399/329
2008/0149211 A1 * 6/2008 Yamada ..... C08L 27/18 138/145
2009/0014942 A1 * 1/2009 Okuno ..... G03G 15/2053 271/4.06
2011/0052245 A1 * 3/2011 Shinshi ..... G03G 15/2025 399/92
2011/0052282 A1 * 3/2011 Shinshi ..... G03G 15/2064 399/329

(Continued)

FOREIGN PATENT DOCUMENTS

JP 4211376 1/2009

*Primary Examiner* — Ryan D Walsh
(74) *Attorney, Agent, or Firm* — Lex IP Meister, PLLC

(57) ABSTRACT

A fixing belt is heated by a heater in contact with an inner circumferential face through a lubricant while rotating about an axis. The fixing belt includes: a belt body formed in a tubular shape; a plurality of oil repellent portions formed on an inner circumferential face of the belt body, each having a surface free energy lower than that of the lubricant to repel the lubricant; and a plurality of oil nonrepellent portions formed on the inner circumferential face of the belt body, each having a surface free energy higher than that of the lubricant to hold the lubricant. The oil repellent portions and the oil nonrepellent portions extend in a circumferential direction of the belt body and are alternately arranged in an axial direction of the belt body.

7 Claims, 12 Drawing Sheets

(56) References Cited

U.S. PATENT DOCUMENTS

| | | | | |
|---|---|---|---|---|
| 2011/0206428 | A1* | 8/2011 | Fujihara | G03G 15/2057 399/333 |
| 2012/0177420 | A1* | 7/2012 | Shimokawa | G03G 15/2017 399/329 |
| 2017/0285537 | A1* | 10/2017 | Onaka | G03G 15/2053 |
| 2018/0011434 | A1* | 1/2018 | Adachi | G03G 15/2025 |
| 2019/0243294 | A1* | 8/2019 | Tanaka | G03G 15/2057 |

* cited by examiner

FIXING BELT, FIXING DEVICE, AND IMAGE FORMING APPARATUS

INCORPORATION BY REFERENCE

This application is based upon, and claims the benefit of priority from, corresponding Japanese Patent Application No. 2018-118190 filed in the Japan Patent Office on Jun. 21, 2018, the entire contents of which are incorporated herein by reference.

BACKGROUND

Field of the Invention

The present disclosure relates to a fixing belt, a fixing device, and an image forming apparatus.

Description of Related Art

An electrographic image forming apparatus includes a fixing device that fixes toner on a medium.

SUMMARY

The fixing belt according to an embodiment of the present disclosure, which is heated by a heating member in contact with an inner circumferential face through a lubricant while rotating about an axis, includes a belt body formed in a tubular shape, a plurality of oil repellent portions formed on an inner circumferential face of the belt body, and a plurality of oil nonrepellent portions formed on the inner circumferential face of the belt body. The plurality of oil repellent portions each have a surface free energy lower than that of the lubricant to repel the lubricant. The plurality of oil nonrepellent portions each have a surface free energy higher than that of the lubricant to hold the lubricant. The plurality of oil repellent portions and the plurality of oil nonrepellent portions extend in a circumferential direction of the belt body and are alternately arranged in an axial direction of the belt body.

The fixing belt according to another embodiment of the present disclosure, which is heated by a heating member in contact with an inner circumferential face through a lubricant while rotating about an axis, includes a belt body formed in a tubular shape, a plurality of oil repellent portions arranged in a latticed manner at intervals in an axial direction and a circumferential direction of an inner circumferential face of the belt body, and an oil nonrepellent portion formed on the inner circumferential face of the belt body exclusive of the plurality of oil repellent portions. The plurality of oil repellent portions each have a surface free energy lower than that of the lubricant to repel the lubricant. The oil nonrepellent portion has a surface free energy higher than that of the lubricant to hold the lubricant.

The fixing belt according to still another embodiment of the present disclosure, which is heated by a heating member in contact with an inner circumferential face through a lubricant while rotating about an axis, includes a belt body formed in a tubular shape, a plurality of oil nonrepellent portions arranged in a latticed manner at intervals in an axial direction and a circumferential direction of an inner circumferential face of the belt body, and an oil repellent portion formed on the inner circumferential face of the belt body exclusive of the plurality of oil nonrepellent portions. The plurality of oil nonrepellent portions each have a surface free energy higher than that of the lubricant to hold the lubricant. The oil repellent portion has a surface free energy lower than that of the lubricant to repel the lubricant.

BRIEF DESCRIPTION OF THE DRAWINGS

FIG. 5 is a schematic cross-sectional view partially illustrating a fixing belt according to the first embodiment of the present disclosure and the like;

DETAILED DESCRIPTION

The following description is made on embodiments of the present disclosure with reference to the accompanying drawings. In the figures, "Fr" represents "front," "Rr" represents "rear," "L" represents "left," "R" represents "right," "U" represents "up," and "D" represents "down." In addition, the terms "upstream" and "downstream" as well as terms analogous thereto refer to "upstream" and "downstream" in the conveyance direction (passing direction) of a sheet S as well as concepts analogous thereto, respectively.

General Configuration of Printer

Figure 1:
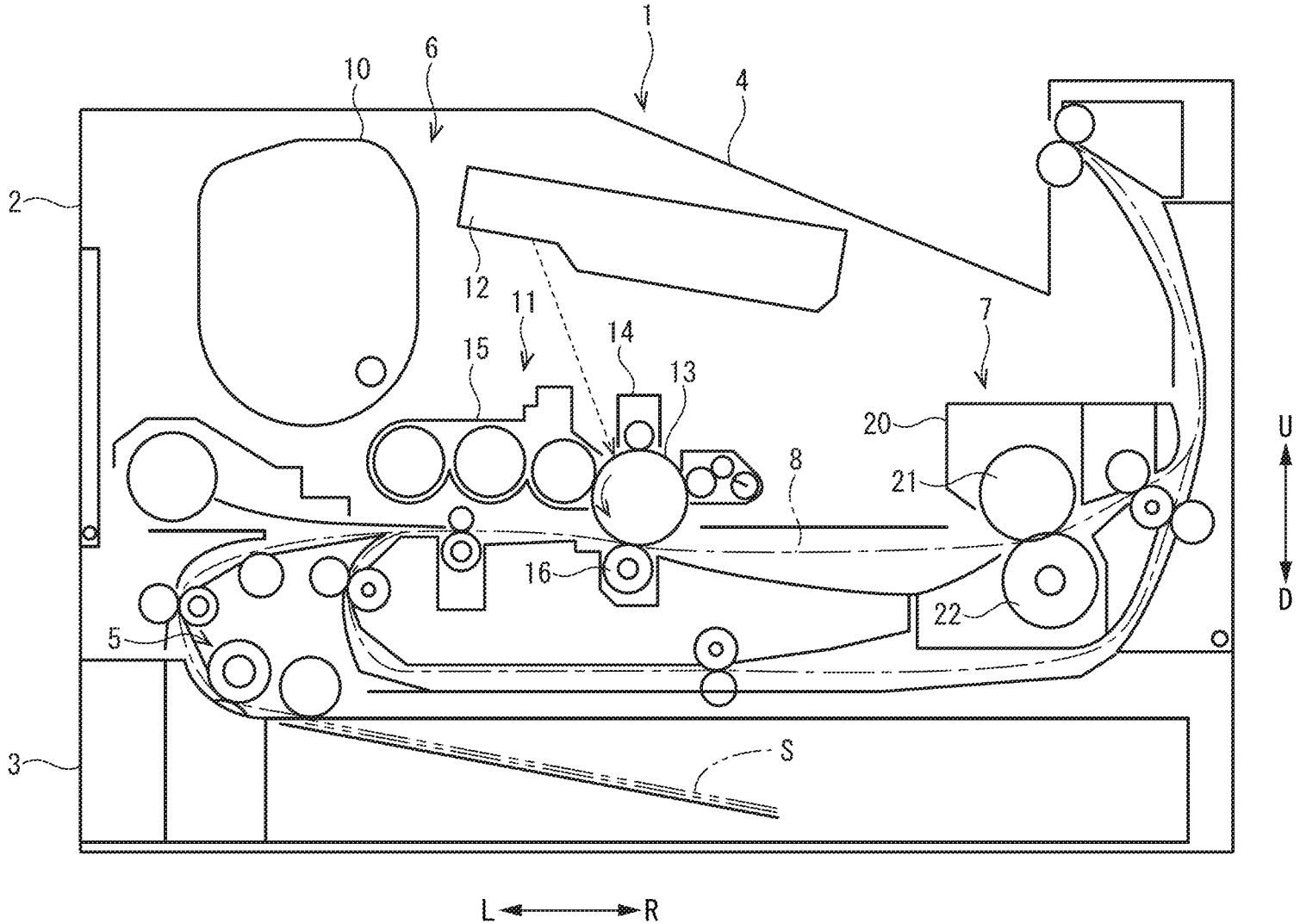
FIG. 1 is a schematic diagram (front view) illustrating a printer according to a first embodiment of the present disclosure.

Referring to FIG. 1, a printer 1 as an exemplary image forming apparatus is described. FIG. 1 is a schematic diagram (front view) illustrating the printer 1.

The printer 1 includes an apparatus body 2 substantially giving an external appearance of a rectangular parallelepiped. In a lower part of the apparatus body 2, a sheet feeding cassette 3 containing a sheet S (medium) of paper, for instance, is detachably provided. At a top face of the apparatus body 2, a sheet discharge tray 4 is provided. The sheet S is not limited to a sheet of paper but may be made of a resin.

The printer 1 also includes a sheet feeding device 5, an image forming device 6, and a fixing device 7. The sheet feeding device 5 is provided at an upstream end of a conveyance path 8 extending from the sheet feeding cassette 3 to the sheet discharge tray 4. The image forming device 6 is provided in a middle part of the conveyance path 8, and the fixing device 7 is provided in a downstream part of the conveyance path 8.

The image forming device 6 includes a toner container 10, a drum unit 11, and an optical scanning device 12. The toner container 10 contains a black toner (developer), for instance. The drum unit 11 includes a photoreceptor drum 13, a charger 14, a developing device 15, and a transfer roller 16. The transfer roller 16 comes into contact with the photoreceptor drum 13 from below to form a transfer nip. The toner may be a two-component developer obtained by mixing a toner and a carrier together or a one-component developer composed of a magnetic toner.

A controller (not shown) for the printer 1 appropriately controls the above devices so as to execute an image forming process as follows. The charger 14 charges the surface of the photoreceptor drum 13. The photoreceptor drum 13 receives the scanning light as emitted from the optical scanning device 12 and carries an electrostatic latent image. The developing device 15 uses the toner as fed from the toner container 10 to develop the electrostatic latent image on the photoreceptor drum 13 into a toner image. The sheet S is delivered from the sheet feeding cassette 3 to the conveyance path 8 by the sheet feeding device 5, and the toner image on the photoreceptor drum 13 is transferred onto the sheet S passing through the transfer nip. The fixing device 7 fixes the toner image to the sheet S. Then, the sheet S is discharged to the sheet discharge tray 4.

First Embodiment: Fixing Device

Figure 2:
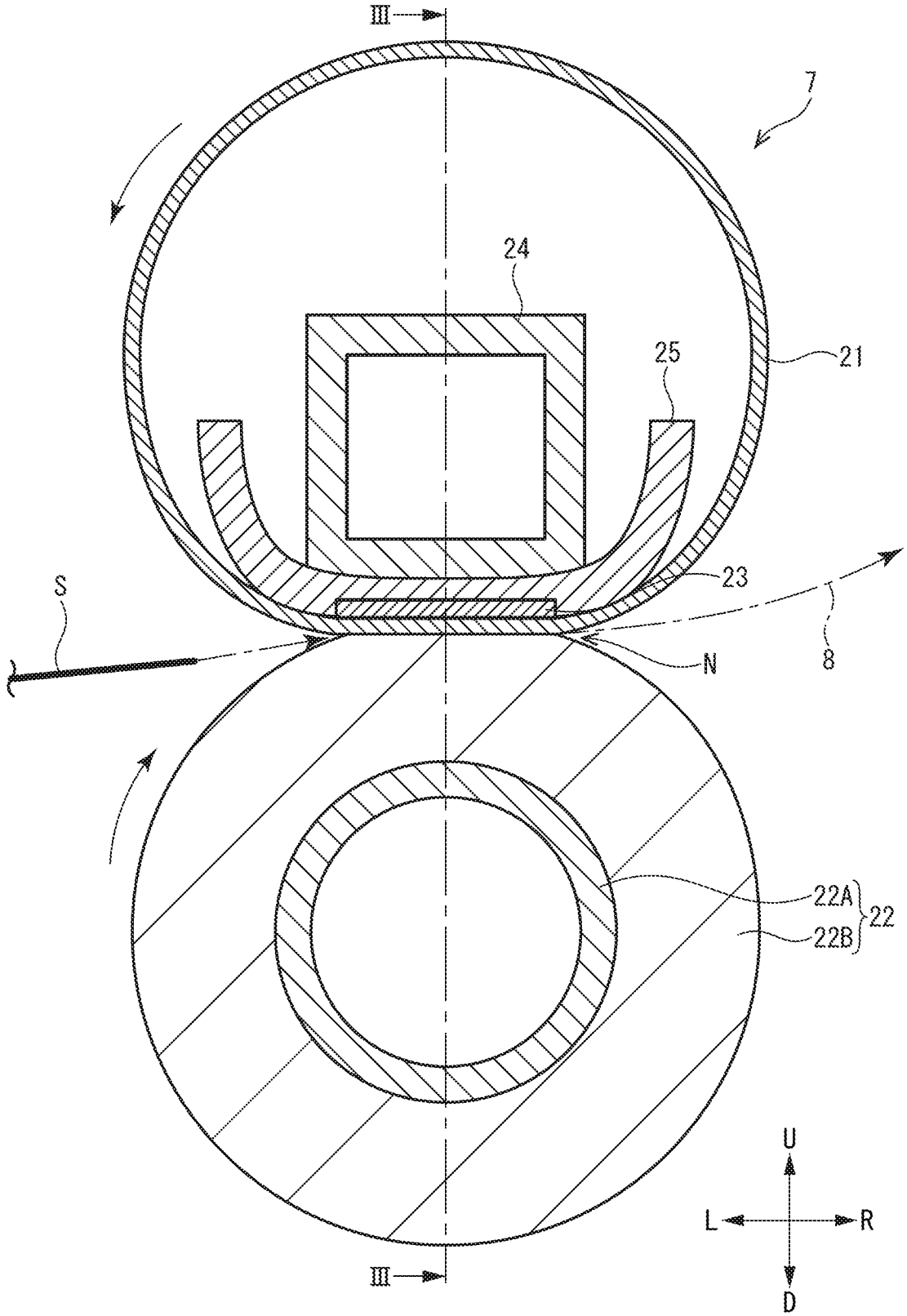
FIG. 2 is a schematic cross-sectional view of a fixing device according to the first embodiment of the present disclosure.
Figure 3:
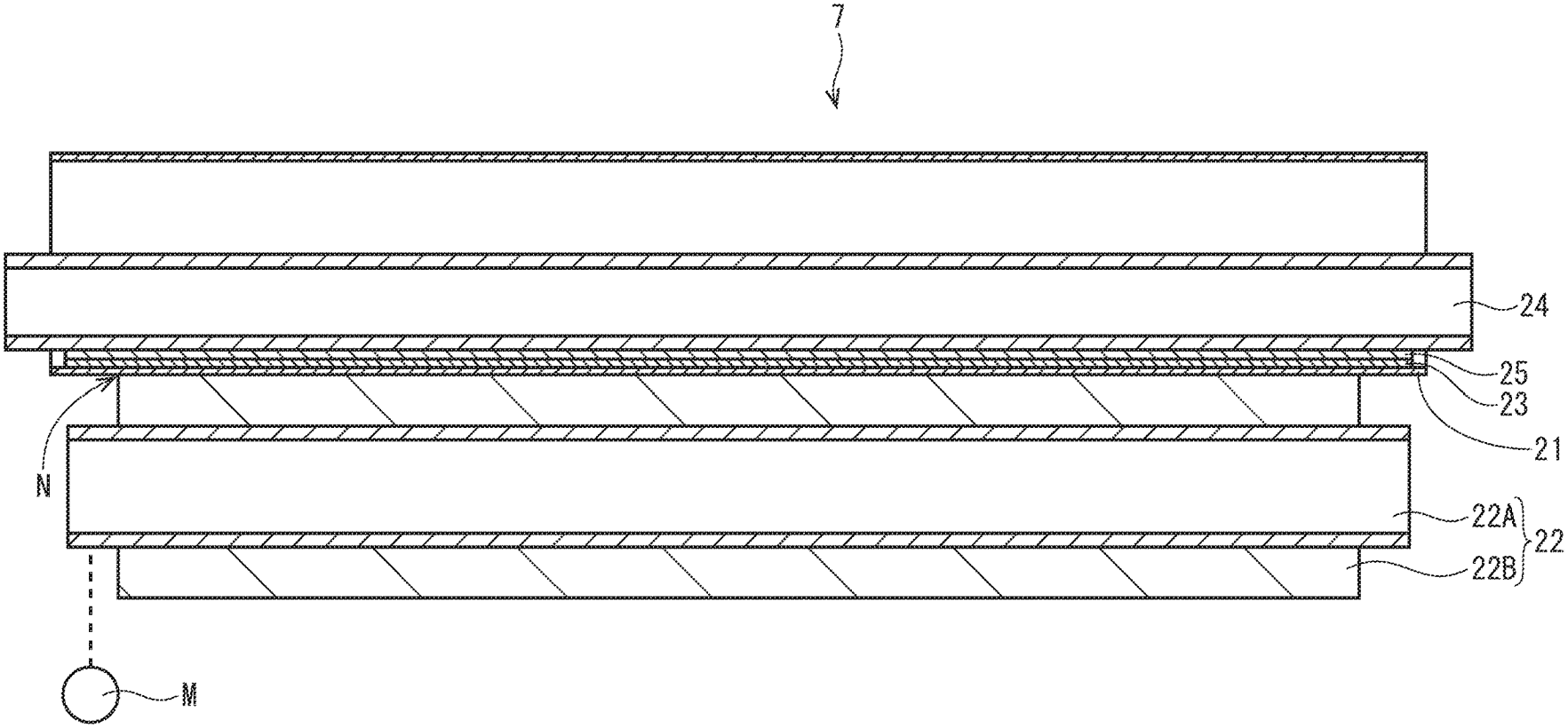
FIG. 3 is a cross section taken along a line in FIG. 2.
Figure 4:
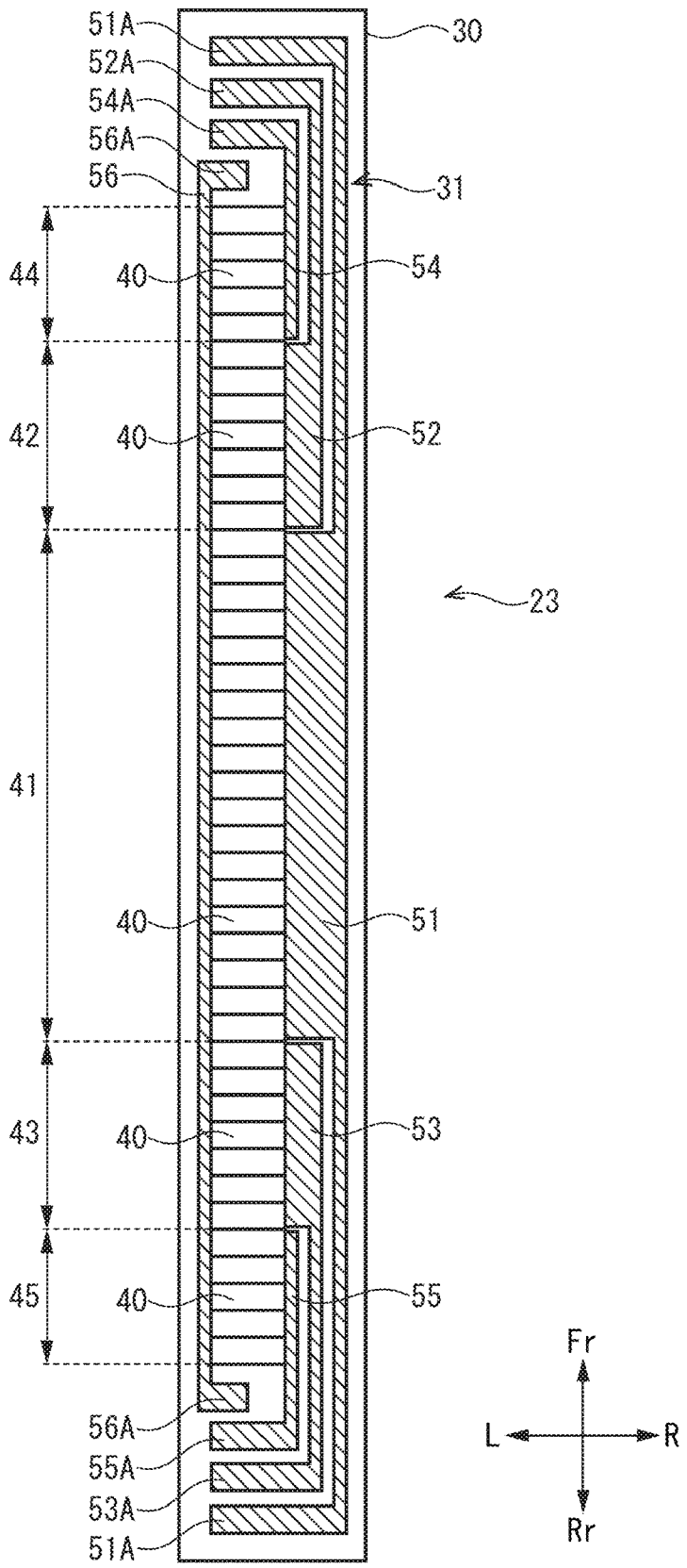
FIG. 4 is a schematic bottom view of a heater of the fixing device according to the first embodiment of the present disclosure.

Next, the fixing device 7 according to the first embodiment is described with reference to FIGS. 1 through 4. FIG. 2 is a schematic cross-sectional view of the fixing device 7. FIG. 3 is a cross section taken along a line in FIG. 2. FIG. 4 is a schematic bottom view of a heater 23.

As shown in FIGS. 1 and 2, the fixing device 7 includes a housing 20, a fixing belt 21, a pressure roller 22, and a heater 23. The housing 20 is supported by the apparatus body 2. The fixing belt 21 and the pressure roller 22 are rotatably supported in the housing 20. The heater 23 is provided inside the fixing belt 21.

Housing

The housing 20 is made of, for instance, a sheet metal or a heat-resistant resin and formed in a substantially rectangular-parallelepipedal shape elongated in the front-to-rear direction. In the housing 20, a part of the conveyance path 8 through which the sheet S passes is formed (see FIG. 1).

Fixing Belt

As shown in FIGS. 2 and 3, the fixing belt 21 is an endless belt and is formed in a substantially cylindrical shape elongated in the front-to-rear direction (axial direction). The fixing belt 21 is positioned above in the housing 20. The cross section structure and the like of the fixing belt 21 will be explained later.

Inside the fixing belt 21, a supporting member 24 is provided. The supporting member 24 is made of, for instance, a metallic material and substantially formed in the shape of rectangular tube elongated in the axial direction. The supporting member 24 penetrates the fixing belt 21 in the axial direction and is supported by the housing 20. Caps (not shown) are attached to both axial ends of the fixing belt 21, and the fixing belt 21 is rotatably supported by the supporting member 24 through a pair of caps. The fixing belt 21 is held in a substantially cylindrical shape by the caps. The fixing belt 21 may be held in a substantially cylindrical shape by providing a belt guide (not shown) inside the fixing belt 21 instead of attaching the caps.

Pressure Roller

The pressure roller 22 as an exemplary pressurizing member is formed in a substantially cylindrical shape elongated in the front-to-rear direction (axial direction). The pressure roller 22 is positioned below in the housing 20. The pressure roller 22 includes a metallic core bar 22A and an elastic layer 22B of a silicone sponge or the like laminated on the outer circumferential face of the core bar. Both axial ends of the core bar 22A are rotatably supported by a pair of movable frames (not shown). The movable frames are so supported by the housing 20 as to be swingable in the vertical direction, and are coupled with a pressure adjustment unit (not shown) including a spring, an eccentric cam, and the like. A drive motor M is coupled with the core bar 22A through a gear train or the like.

If the pressure adjustment unit makes the movable frames pivot toward the fixing belt 21, the pressure roller 22 is pressed against the fixing belt 21 to form a pressurizing region N under pressure between the pressure roller in itself and the fixing belt 21. If the pressure adjustment unit makes the movable frames pivot away from the fixing belt 21, the pressure roller 22 is released from being pressed against the fixing belt 21, so as to make the pressurizing region N reduced in pressure. The pressurizing region N refers to a region extending from an upstream position with a pressure of 0 Pa to a downstream position with a pressure of 0 Pa again via a position with the maximum pressure.

Heater

The heater 23 as an exemplary heating member is substantially formed in the shape of rectangular plate elongated in the front-to-rear direction (axial direction). The heater 23 is secured to a lower face of the supporting member 24 through a holding member 25 (see FIG. 2). The holding member 25 is made of, for instance, a heat-resistant resin material and formed in a substantially half-cylindrical shape elongated in the axial direction. The holding member 25 is so curved as to follow a lower inner face of the fixing belt 21 (see FIG. 2).

As shown in FIG. 4, the heater 23 includes a substrate 30 and a heat generating contact portion 31.

Substrate

The substrate 30 is constructed by laminating (forming) a heat insulating layer on a base. The base and the heat insulating layer are made of a material that is not only electrically insulative but has a low thermal conductivity, such as ceramics, for instance. The substrate 30 (heat insulating layer thereof) has a function of restricting the transfer of heat generated in the heat generating contact portion 31.

Heat Generating Contact Portion

The heat generating contact portion 31 is laminated on a lower face of the substrate 30 (heat insulating layer thereof). The heat generating contact portion 31 includes a plurality of (for example, five) heat generating sections 41 through 45 and a plurality of (for example, six) electrode sections 51 through 56.

The heat generating sections 41 through 45 are formed on the substrate 30 (heat insulating layer thereof) with a conductive material such as metal having a resistance value higher than that of a material for the electrode sections 51 through 56. The heat generating sections 41 through 45 are aligned with one another in the axial direction. The heat generating sections 41 through 45 are each composed of a plurality of resistance heating elements 40 aligned with one another in the axial direction. The resistance heating elements 40 are each formed in a substantially rectangular shape elongated in the passing direction.

The heat generating section 41 as located in the middle in the axial direction is composed of the resistance heating elements 40 which are arranged in a range corresponding to the front-to-rear width of a sheet S with a small size (for example, A5 paper size) passing through the pressurizing region N. The heat generating sections 42 and 43 as located on both sides in the axial direction of the heat generating section 41 are composed of the resistance heating elements 40 which are arranged in a range corresponding to the front-to-rear width of a sheet S with a medium size (for example, B5 paper size) passing through the pressurizing region N. The heat generating sections 44 and 45, which are located on two sides in the axial direction of the heat generating sections 42 and 43, respectively, are composed of the resistance heating elements 40 which are arranged in a range corresponding to the front-to-rear width of a sheet S with a normal size (for example, A4 paper size) passing through the pressurizing region N.

The electrode sections 51 through 56 are formed on the substrate 30 (heat insulating layer thereof) with a conductive material such as metal, for instance. The electrode sections 51 through 55 are connected to the downstream ends (right ends in the figure) of the heat generating sections 41 through 45 (individual resistance heating elements 40 thereof), respectively. On the other hand, the electrode section 56 is connected to the upstream ends (left ends in the figure) of all the resistance heating elements 40. The electrode sections 51 through 56 extend over the connection with the heat generating sections 41 through 45 upto positions more external in the axial direction than the heat generating sections 41 through 45, respectively. To tips of the respective electrode sections 51 through 56, electrode terminals 51A through 56A are connected.

The heat generating contact portion 31 is coated with a coating layer (not shown) except for the electrode terminals 51A through 56A. The coating layer is made of a material that is not only electrically insulative but has a small friction with respect to the fixing belt 21, such as ceramics, for instance.

The heater 23 directs the heat generating contact portion 31 to the pressure roller 22 and is, as such, held on a lower face of the holding member 25, with the heat generating contact portion 31 being thus made in contact with an inner face of the fixing belt 21 (see FIG. 2). The heater 23 blocks the fixing belt 21 pressed by the pressure roller 22, so that the region of contact between the fixing belt 21 and the pressure roller 22 constitutes the pressurizing region N. The heater 23, which is in contact with an inner circumferential face of the fixing belt 21 at a position corresponding to the pressurizing region N, heats the fixing belt 21.

The housing 20 is provided with a temperature sensor (not shown) for detecting the surface temperature of the fixing belt 21 or the temperature of the heater 23. The electrode terminals 51A through 56A of the heater 23, the drive motor M, and the like are electrically connected with a power source (not shown) through various drive circuits (not shown). In addition, the heater 23, the drive motor M, the temperature sensor, and the like are electrically connected to the controller of the printer 1 through various circuits. The controller controls the devices and the like as connected thereto.

Function of Fixing Device

The function (fixing process) of the fixing device 7 is now described. During the fixing process, the pressure roller 22 has been pressed against the fixing belt 21 by the pressure adjustment unit.

The controller controls the driving of the heater 23 and the drive motor M. The pressure roller 22 receives the driving force of the drive motor M and rotates accordingly, and the fixing belt 21 is driven to rotate by the pressure roller 22 (see solid arrows in FIG. 2). Each resistance heating element 40 generates heat by making an electric current flow in the passing direction between the electrode sections 51 through 56 sandwiching the heat generating sections 41 through 45.

During the heat generation, the controller selects the heat generating section or sections to be driven from among the heat generating sections 41 through 45 (see FIG. 4) according to the size of the sheet S. If a sheet S with a normal size passes through the pressurizing region N, for instance, the controller feeds electric power to all the heat generating sections 41 through 45 to cause all the heat generating sections 41 through 45 to generate heat. For instance, the controller can cause the heat generating sections 41 through 43 to generate heat if a sheet S with a medium size passes through the pressurizing region N, and cause the heat generating section 41 to generate heat if a sheet S with a small size passes through the pressurizing region N. It is thus possible to heat only a necessary part of the fixing belt 21 (the pressurizing region N) in accordance with the size of the sheet S. As a result, excessive temperature rise is suppressed at both axial ends of the fixing belt 21 where the sheet S does not pass.

The temperature sensor detects the surface temperature of the fixing belt 21 and transmits a detection signal to the controller through an input circuit. Upon receipt, from the temperature sensor, of a detection signal indicating that the set temperature (of 150 through 200° C., for instance) has been reached, the controller starts execution of the image forming process as described before while controlling the heater 23 so that the set temperature may be maintained. The sheet S with a toner image transferred thereto enters the housing 20, and the fixing belt 21 rotating about the axis is heated by the heater 23 in contact with the inner circumferential face of the belt through a lubricant. The fixing belt 21 as such heats the toner (toner image) on the sheet S passing through the pressurizing region N. The pressure roller 22 rotating about the axis pressurizes the toner on the sheet S passing through the pressurizing region N. As a result, the toner image is fixed to the sheet S. The sheet S with the toner image fixed thereto is delivered out of the housing 20 and discharged to the sheet discharge tray 4.

The fixing belt 21 is sandwiched between the pressure roller 22 and the heater 23 at a position corresponding to the pressurizing region N, and rotates as pressed against a lower face of the heater 23. In order to reduce the frictional resistance between the fixing belt 21 and the heater 23, a lubricant such as silicone oil or fluorine grease is applied onto the inner circumferential face of the fixing belt 21 (or, the surface of the heater 23). The lubricant lying between the fixing belt 21 and the heater 23 may move outward in the axial direction along with the rotation of the fixing belt 21 and leak from the axial ends of the fixing belt 21. The leaked lubricant may contaminate the sheet S. In addition, since the lubricant lying between the fixing belt 21 and the heater 23 decreases as a result of leakage, the rotational load of the fixing belt 21 may be increased. The fixing belt 21 according to the first embodiment has a structure allowing the suppression of leakage of the lubricant from the axial ends.

Cross Section Structure of Fixing Belt

Figure 5:
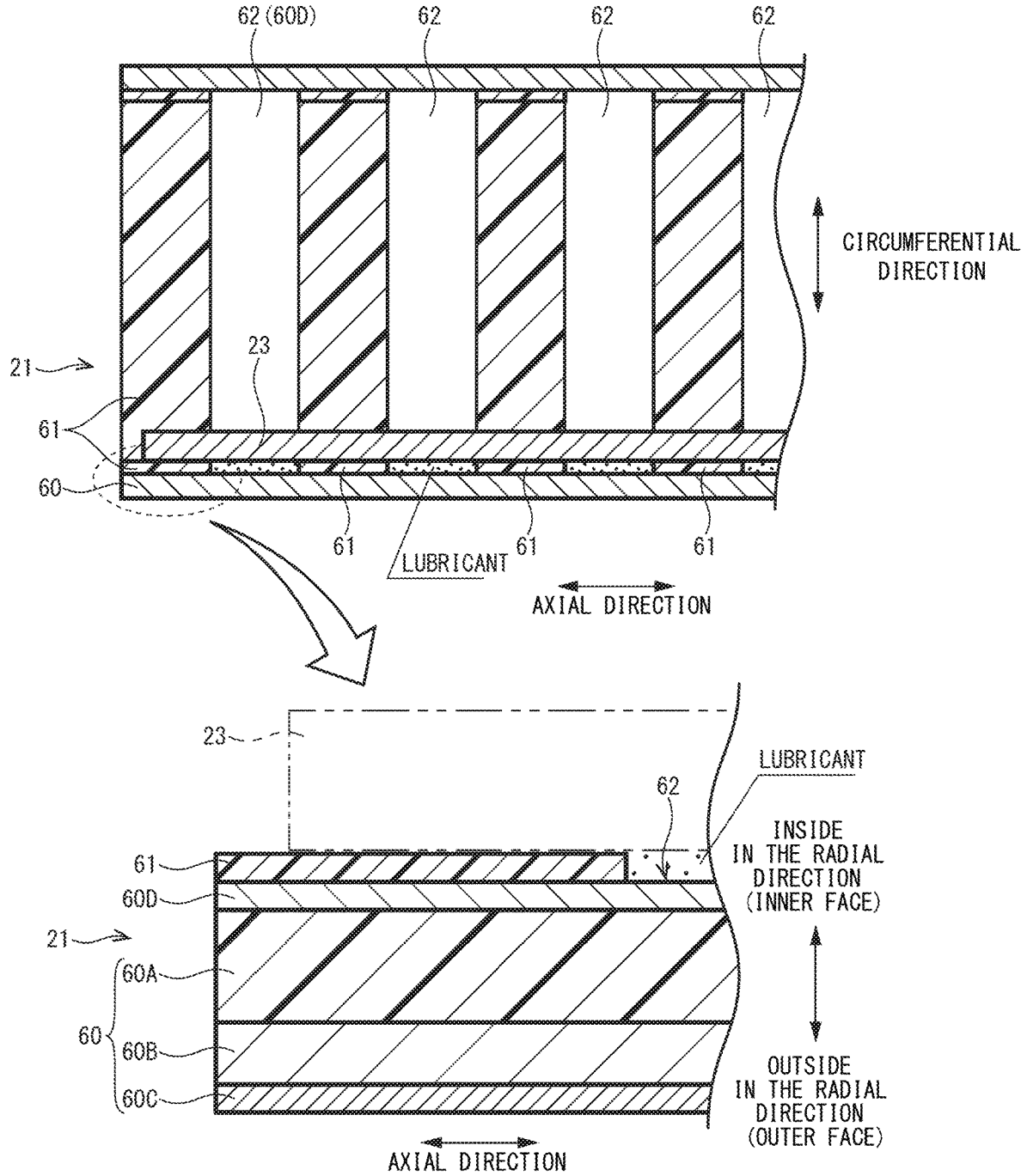
Figure 6:
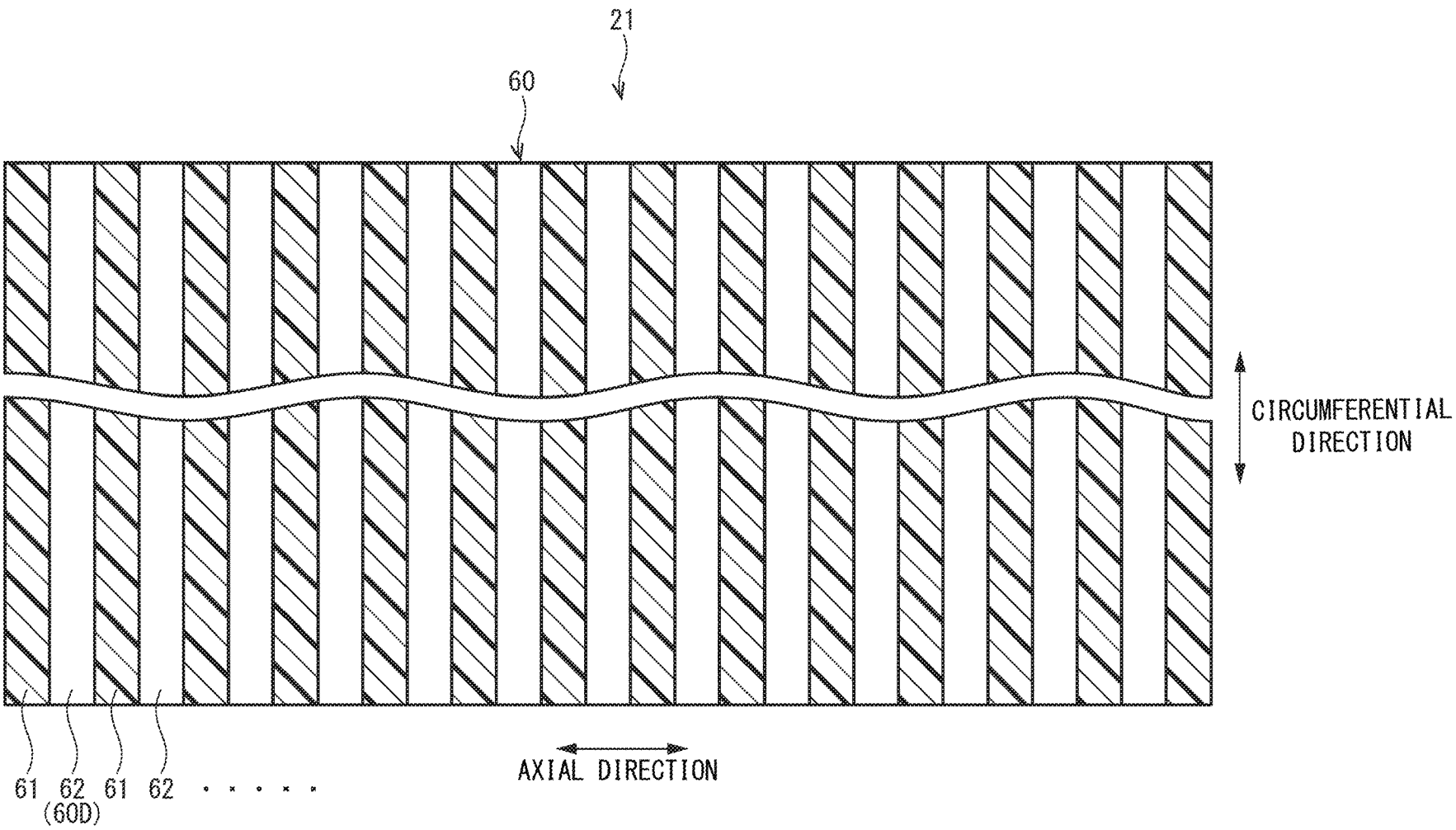
FIG. 6 is a development of the fixing belt according to the first embodiment of the present disclosure.

Referring to FIGS. 5 and 6, description is made on the cross section structure and so forth of the fixing belt 21. FIG. 5 is a schematic cross-sectional view partially illustrating the fixing belt 21 and the like. FIG. 6 is a development of the fixing belt 21. The dimensions, proportions, and the like, of respective parts as seen from the figures are not accurate, that is to say, are simplified for the sake of illustration.

As shown in FIG. 5, the fixing belt 21 includes a belt body 60, a plurality of oil repellent portions 61, and a plurality of oil nonrepellent portions 62. The belt body 60 is formed in a substantially cylindrical shape. The oil repellent portions 61 and the oil nonrepellent portions 62 are formed on the inner circumferential face of the belt body 60.

Belt Body

As shown in a lower part of FIG. 5, the belt body 60 is formed by laminating a base 60A, a rubber layer 60B and a release layer 60C in this order from the inside toward the outside in the radial direction. The base 60A is composed of a layer of metal (stainless steel, aluminum alloy, nickel or the like) that has a thickness of about 30 μm. The rubber layer 60B is a silicone rubber layer with a thickness of about 300 μm that is laminated on the base 60A. The release layer 60C is a layer of fluororesin (polytetrafluoroethylene (PTFE), tetrafluoroethylene-perfluoroalkyl vinyl ether copolymer (PFA) or the like) that is laminated on the rubber layer 60B. The release layer 60C has a function of suppressing adhesion of the sheet S, for instance.

On the inner circumferential face of the base 60A (or, the belt body 60), a coating layer 60D with a thickness of about 1 through 30 μm is laminated. The coating layer 60D includes a polyimide resin. Polyimide resins, as being excellent in heat resistance, having a good (high) affinity (wettability) to the lubricant, and having a very low coefficient of friction, are suitably used for the coating layer 60D. The coating layer 60D may include, apart from a polyimide resin, a polybenzimidazole resin, a polyamide resin, a polyamide imide resin.

Oil Repellent Portion

As shown in FIGS. 5 and 6, the (fourteen) oil repellent portions 61 are each laminated on the coating layer 60D. The oil repellent portions 61 are each formed in a strip shape extending in the circumferential direction of the belt body 60. The oil repellent portions 61 are arranged at substantially equal intervals in the axial direction of the belt body 60.

The oil repellent portions 61 include a fluororesin so that they may have a surface free energy lower than that of the lubricant to repel the lubricant. Specifically, the oil repellent portions 61 are each a layer of polytetrafluoroethylene (PTFE) having a thickness of about 1 through 30 μm. PTFE, as being excellent in heat resistance and wear resistance, having a low affinity (wettability) to the lubricant, and having a very low coefficient of friction, is suitably used for the oil repellent portions 61. The oil repellent portions 61 may include, apart from PTFE, a tetrafluoroethylene-perfluoromethyl vinyl ether copolymer (MFA), a tetrafluoroethylene-perfluoroethyl vinyl ether copolymer (EFA), polyethylene tetrafluoroethylene (ETFE), a tetrafluoroethylene-perfluoroalkyl vinyl ether copolymer (PFA), or a tetrafluoroethylene-hexafluoropropylene copolymer (FEP).

Oil Nonrepellent Portion

As shown in FIGS. 5 and 6, the (thirteen) oil nonrepellent portions 62 are composed of the regions on the coating layer 60D where no oil repellent portions 61 are laminated. In other words, the oil nonrepellent portions 62 are each composed of the coating layer 60D as bared between the oil repellent portions 61. Accordingly, the oil nonrepellent portions 62 are recessed outward in the radial direction from the oil repellent portions 61 with a minute difference in height (see the lower part of FIG. 5). The oil nonrepellent portions 62 are each formed in a strip shape extending in the circumferential direction of the belt body 60. The oil nonrepellent portions 62 include (or, the coating layer 60D includes) a polyimide resin so that they (it) may have a surface free energy higher than that of the lubricant to hold the lubricant.

As an example, the oil nonrepellent portions 62 have the same width as the oil repellent portions 61. Specifically, the width of the oil repellent portions 61 is set to 10 mm, and the width of the oil nonrepellent portions 62 is set to 10 mm. In other words, the oil repellent portions 61 are arranged at intervals of 10 mm. The oil repellent portions 61 and the oil nonrepellent portions 62 extend in the circumferential direction of the belt body 60 and are alternately arranged in the axial direction of the belt body 60. Out of the oil repellent portions 61, a pair of oil repellent portions 61 are positioned at both axial ends of the inner circumferential face of the belt body 60.

The fixing belt 21 as described above can be manufactured using an existing coating method. For instance, the rubber layer 60B and the release layer 60C can be formed on an outer circumferential face of the base 60A using a dipping method. For instance, the coating layer 60D (constituting the oil nonrepellent portions 62) can be formed on the inner circumferential face of the base 60A using a spray coating method. Further, for instance, the oil repellent portions 61 can be formed on the coating layer 60D by a spray coating method after masking the regions, on the coating layer 60D, which constitute the oil nonrepellent portions 62. During the formation of the oil repellent portions 61 and the oil nonrepellent portions 62, a bonding primer may be used as required.

In the above-described fixing belt 21 according to the first embodiment, the lubricant moving outward in the axial direction along with the rotation of the fixing belt 21 is repelled by the respective oil repellent portions 61. Thus, each oil repellent portion 61 exerts a function of blocking the lubricant moving outward in the axial direction. As a result, the leakage of the lubricant from the axial ends of the fixing belt 21 is suppressed. The lubricant is blocked by each oil repellent portion 61 and retained in the oil nonrepellent portion 62 between the oil repellent portions 61 adjacent to each other. The lubricant is thus allowed to continuously lie between the belt body 60 and the heater 23, which ensures a smooth rotation of the fixing belt 21. In consequence, the wear of the fixing belt 21 and the like is suppressed.

In the fixing belt 21 according to the first embodiment, a pair of oil repellent portions 61 positioned at both axial ends of the inner circumferential face of the belt body 60 block the lubricant, so that it is possible to effectively suppress the leakage of the lubricant from both axial ends of the fixing belt 21. From the viewpoint of preventing the leakage of the lubricant, it is preferable to position the oil repellent portions 61 at both axial ends of the belt body 60, although such positioning is not indispensable. The oil nonrepellent portions 62 may constitute both axial ends of the inner circumferential face of the belt body 60.

Also in the fixing belt 21 according to the first embodiment, the oil repellent portions 61 are formed of a material including a fluororesin and the oil nonrepellent portions 62 are formed of a material including a polyimide resin, so as to make the contact angle between the oil nonrepellent portions 62 and the lubricant smaller than the contact angle between the oil repellent portions 61 and the lubricant.

Consequently, the lubricant is repelled by the oil repellent portions 61 and held by the oil nonrepellent portions 62.

In the fixing belt 21 according to the first embodiment, the oil repellent portions 61 and the oil nonrepellent portions 62 are so formed as to have the same width, to which the present disclosure is not limited. For instance, the oil nonrepellent portions 62 may be wider or narrower than the oil repellent portions 61.

Figure 7:
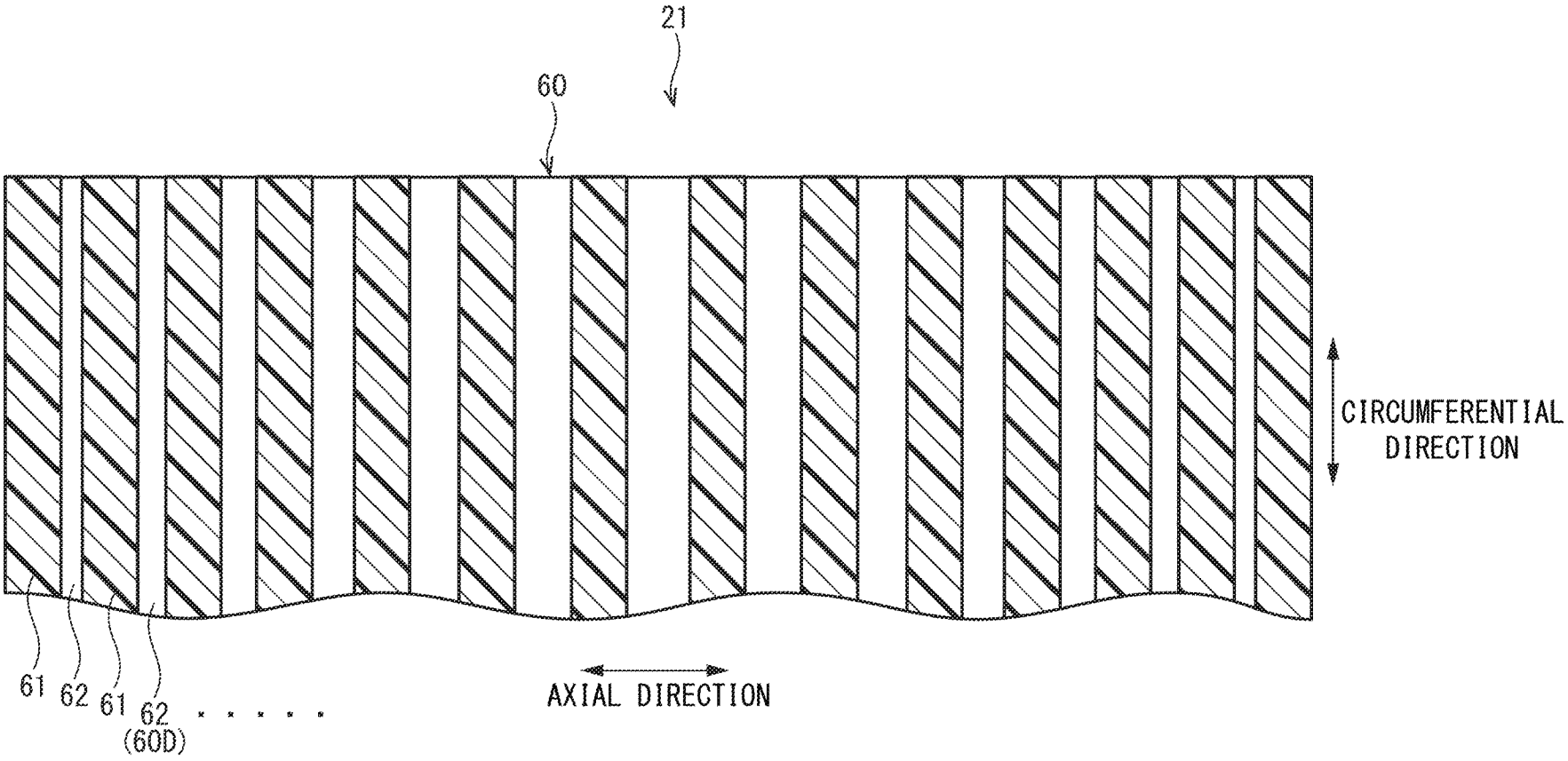
FIG. 7 is a development of a fixing belt according to a first modification of the first embodiment of the present disclosure.
Figure 8:
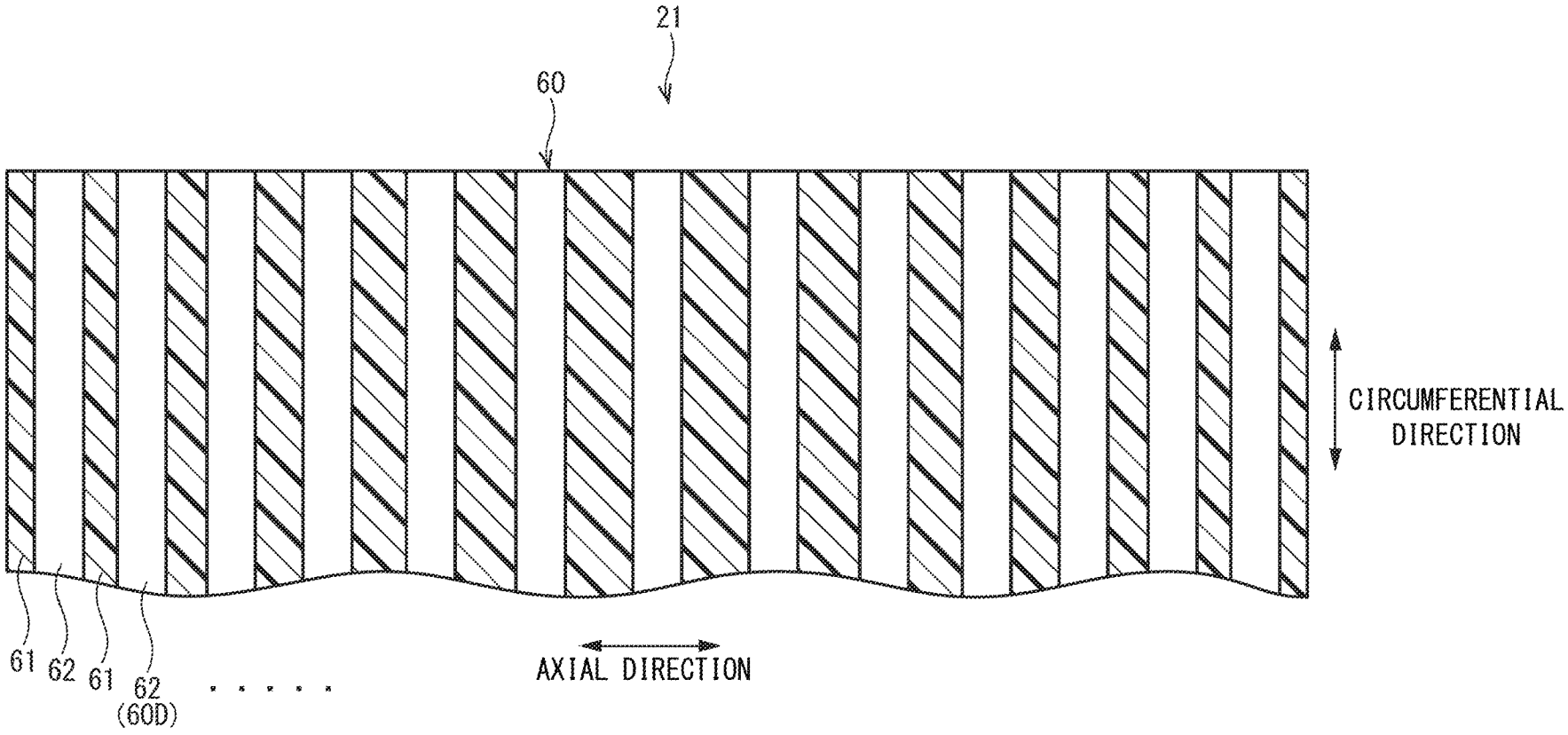
FIG. 8 is a development of a fixing belt according to a second modification of the first embodiment of the present disclosure.

In the fixing belt 21 according to the first embodiment, the oil repellent portions 61 (or, the oil nonrepellent portions 62) are arranged at substantially equal intervals, to which the present disclosure is not limited. As an example, the oil repellent portions 61 may be arranged at intervals gradually narrowed from the center toward both ends in the axial direction, as shown in FIG. 7 (first modification). In other words, the oil nonrepellent portions 62 may have an axial width gradually reduced from the center toward both ends in the axial direction. In addition to the above, as shown in FIG. 8, the oil repellent portions 61 may have an axial width gradually reduced from the center toward both ends in the axial direction (second modification). The oil repellent portions 61 or the oil nonrepellent portions 62 may also have an axial width gradually increased from the center toward both ends in the axial direction (not shown).

Second Embodiment

Figure 9:
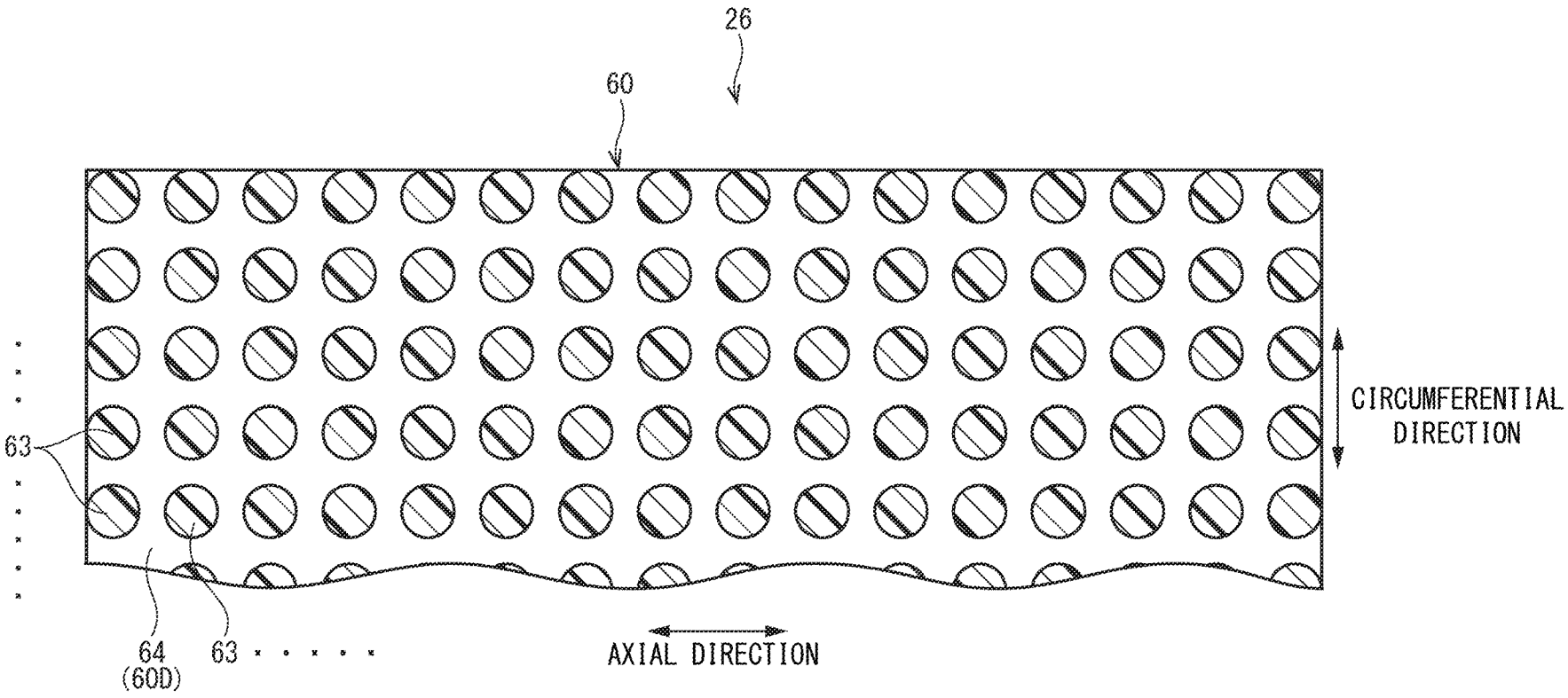
FIG. 9 is a development of a fixing belt according to a second embodiment of the present disclosure.

A fixing belt 26 according to a second embodiment is described with reference to FIG. 9. FIG. 9 is a development of the fixing belt 26 according to the second embodiment. In the following, the components which are the same as or corresponding to those of the fixing belt 21 according to the first embodiment are denoted by the same reference signs, and are no more described.

In the fixing belt 26 according to the second embodiment, a plurality of oil repellent portions 63 are each formed in a circular shape, and are arranged in a latticed manner at intervals in the axial and circumferential directions of the inner circumferential face of the belt body 60, which is a difference from the fixing belt 21 according to the first embodiment. The oil repellent portions 63 are aligned with one another on the coating layer 60D at substantially equal intervals in the axial and circumferential directions. Accordingly, an oil nonrepellent portion 64 is formed on the inner circumferential face of the belt body 60 exclusive of the oil repellent portions 63. In other words, the oil nonrepellent portion 64 is composed of the coating layer 60D as bared in the region where no oil repellent portions 63 are formed.

The oil repellent portions 63 are arranged at intervals of 5 mm in the axial and circumferential directions. The oil repellent portions 63 each have a diameter of 10 mm, and the total area of the oil repellent portions 63 is set to about 30% of the area of the oil nonrepellent portion 64.

In the above-described fixing belt 26 according to the second embodiment, the oil repellent portions 63 as arranged in a latticed manner block the lubricant moving outward in the axial direction, so that it is possible to suppress the leakage of the lubricant from the axial ends of the fixing belt 26.

Figure 10:
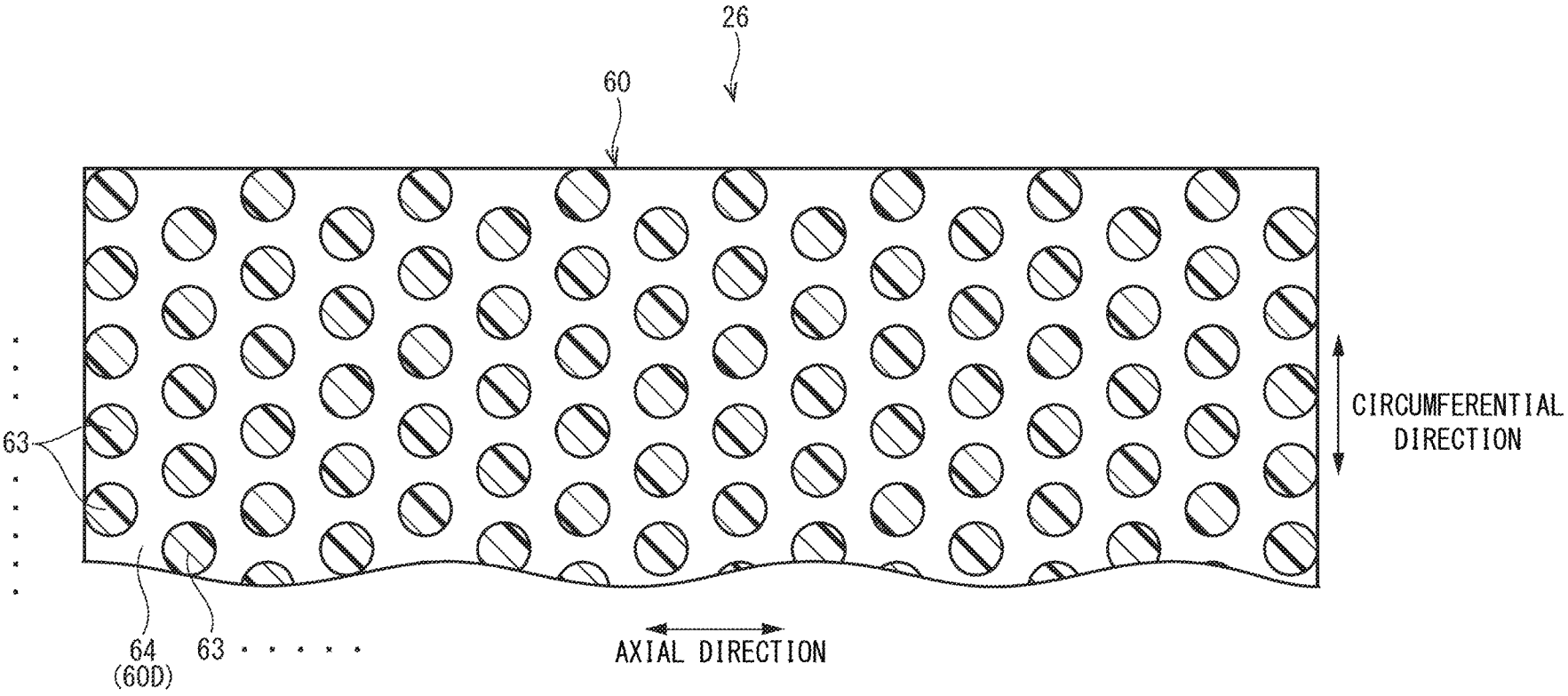
FIG. 10 is a development of a fixing belt according to a first modification of the second embodiment of the present disclosure.
Figure 11:
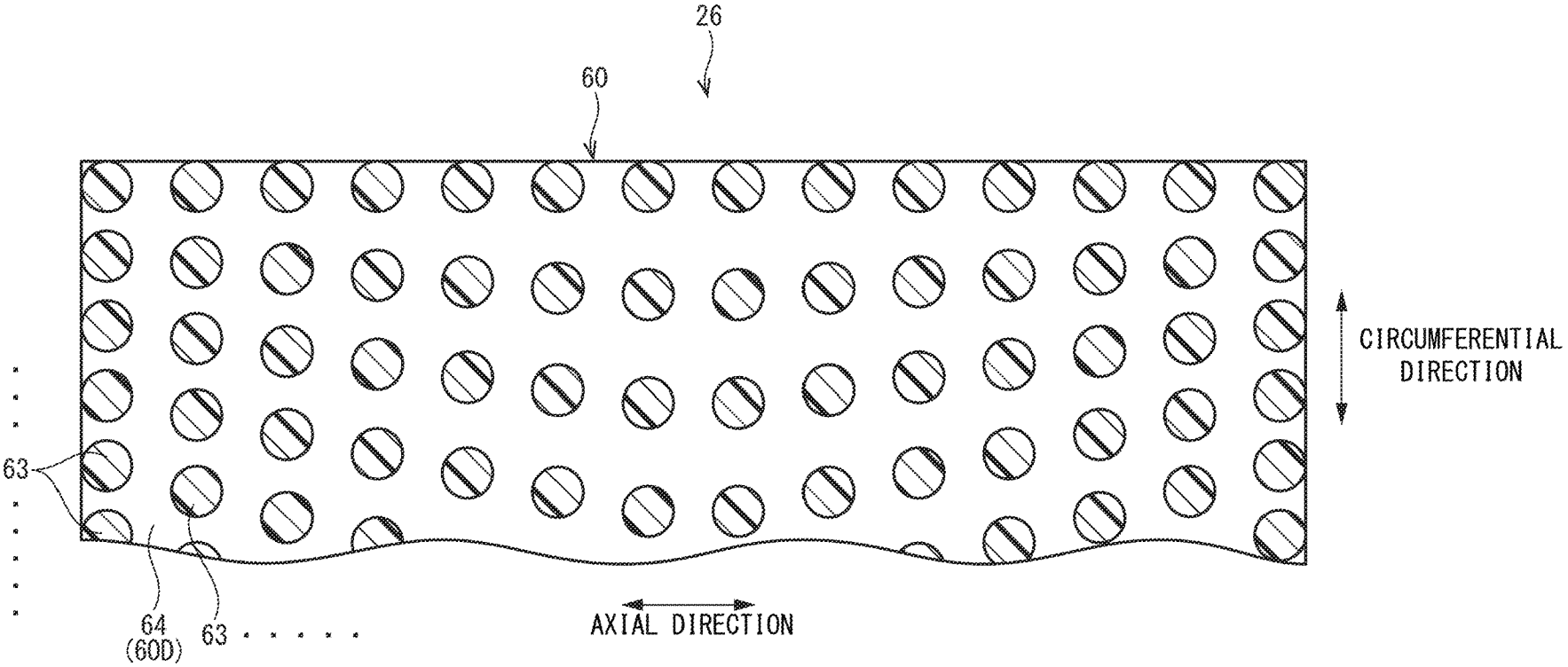
FIG. 11 is a development of a fixing belt according to a second modification of the second embodiment of the present disclosure.

In the fixing belt 26 according to the second embodiment, the oil repellent portions 63 are arranged at substantially equal intervals in the axial and circumferential directions, to which the present disclosure is not limited. As an example, the oil repellent portions 63 may be arranged in a zigzag form shifted by half a pitch in the circumferential (or axial) direction, as shown in FIG. 10 (first modification). In addition to the above, as shown in FIG. 11, the oil repellent portions 63 may be arranged at circumferential intervals gradually narrowed from the center toward both ends in the axial direction (second modification). The oil repellent portions 63 may also be arranged conversely, that is to say, at circumferential intervals gradually widened from the center toward both ends in the axial direction (not shown). Instead of/Apart from the above case where the circumferential intervals are changed, the oil repellent portions 63 may be arranged at axial intervals gradually narrowed or widened from the center toward both ends in the axial direction (not shown). Furthermore, instead of/apart from the case where the intervals are changed as described above, the oil repellent portions 63 may be formed with a diameter gradually decreased or increased from the center toward both ends in the axial direction (not shown).

The oil repellent portions 63 of the fixing belt 26 according to the second embodiment are each formed in a circular shape, although not limited to such configuration. The oil repellent portions may have an elliptical shape or the shape of a polygon such as a tetragon.

Third Embodiment

Figure 12:
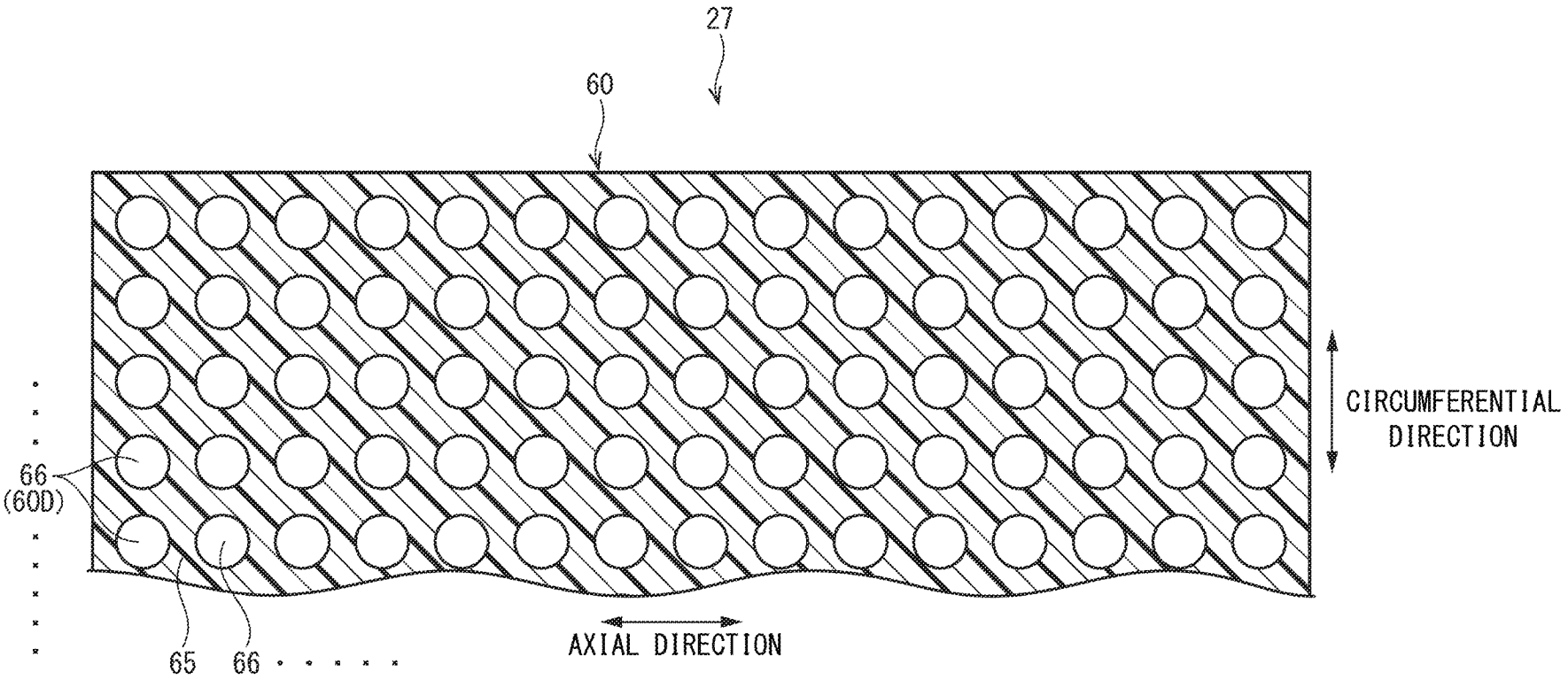
FIG. 12 is a development of a fixing belt according to a third embodiment of the present disclosure.

A fixing belt 27 according to a third embodiment is described with reference to FIG. 12. FIG. 12 is a development of the fixing belt 27 according to the third embodiment. In the following, the components which are the same as or corresponding to those of the fixing belt 21 or 26 according to the first or second embodiment are denoted by the same reference signs, and are no more described.

In the fixing belt 27 according to the third embodiment, a plurality of oil nonrepellent portions 66 are arranged in a latticed manner at intervals in the axial and circumferential directions of the inner circumferential face of the belt body 60, and an oil repellent portion 65 is formed on the inner circumferential face of the belt body 60 exclusive of the oil nonrepellent portions 66. Consequently, the arrangement of the oil nonrepellent portions 66 and the oil repellent portion 65 of the fixing belt 27 according to the third embodiment is reverse to the arrangement of the oil nonrepellent portion 64 and the oil repellent portions 63 of the fixing belt 26 according to the second embodiment. The oil nonrepellent portions 66 are each formed in a circular shape, and are aligned with one another at substantially equal intervals in the axial and circumferential directions. The oil repellent portion 65 is so formed on the coating layer 60D as to leave parts of the layer that constitute the oil nonrepellent portions 66. In other words, the oil nonrepellent portions 66 are each composed of the coating layer 60D as bared in the parts without the oil repellent portion 65.

The oil nonrepellent portions 66 are arranged at intervals of 5 mm in the axial and circumferential directions. The oil nonrepellent portions 66 each have a diameter of 10 mm, and the total area of the oil nonrepellent portions 66 is set to about 30% of the area of the oil repellent portion 65.

In the above-described fixing belt 27 according to the third embodiment, the oil repellent portion 65 is widely formed on the inner circumferential face of the belt body 60 avoiding the oil nonrepellent portions 66, so that it is possible to retain the lubricant in the oil nonrepellent portions 66. As a result, the leakage of the lubricant from the axial ends of the fixing belt 27 is suppressed, which ensures a smooth rotation of the fixing belt 27.

In the fixing belt 27 according to the third embodiment, the oil nonrepellent portions 66 are arranged at substantially equal intervals in the axial and circumferential directions, to which the present disclosure is not limited. Similar to the first modification of the second embodiment, the oil nonrepellent portions 66 may be arranged in a zigzag form (not shown). The axial or/and circumferential intervals between the oil nonrepellent portions 66 may be changed, similarly to the second modification of the second embodiment (not shown). Furthermore, instead of/apart from the case where the intervals are changed as described above, the oil nonrepellent portions 66 may be formed with a diameter gradually decreased or increased from the center toward both ends in the axial direction (not shown).

The oil nonrepellent portions 66 of the fixing belt 27 according to the third embodiment are each formed in a circular shape, although not limited to such configuration. The oil nonrepellent portions may have an elliptical shape or the shape of a polygon such as a tetragon.

In each of the fixing belts 21, 26 and 27 according to any of the first through third embodiments (including the respective modifications; the same applying in the following), the coating layer 60D (or, the oil nonrepellent portions 62, 64 or 66) is laminated on the inner circumferential face of the base 60A, and the oil repellent portions 61, 63 or 65 are laminated on the coating layer 60D, to which the present disclosure is not limited. As an example, the oil repellent portions 61, 63 or 65 may be laminated on the inner circumferential face of the base 60A, and the oil nonrepellent portions 62, 64 or 66 may be laminated on the oil repellent portions 61 (not shown). In other words, the oil nonrepellent portions 62, 64 or 66 may be protruded inward in the radial direction from the oil repellent portions 61, 63 or 65 with a minute difference in height. In addition to the above, the oil repellent portions 61, 63 or 65 and the oil nonrepellent portions 62, 64 or 66 may directly be laminated on the inner circumferential face of the base 60A with no difference in height between the oil repellent portions 61, 63 or 65 and the oil nonrepellent portions 62, 64 or 66.

In the fixing device 7 according to any of the first through third embodiments, the heat generating sections 41 through 45 correspond to the sizes of the three types of sheets S, although not limited to such configuration. The heat generating sections (namely, the resistance heating elements 40) only need to correspond to the sizes of at least two types of sheets S. The configuration, in which the sheet S passes through the middle in the axial direction of the pressurizing region N, is not limitative. The sheet S may pass through the pressurizing region N at a position closer to one side in the axial direction of the region.

Also in the fixing device 7 according to any of the first through third embodiments, the drive motor M rotatively drives the pressure roller 22, while the fixing belt 21, 26 or 27 may rotatively be driven instead. The configuration, in which the pressure adjustment unit changes the pressure in the pressurizing region N by moving the pressure roller 22, is not limitative. The pressure in the pressurizing region N may be changed by moving the fixing belt 21, 26 or 27.

In the first through third embodiments as described above, the present disclosure is applied to the printer 1 of a monochrome type as an example. The present disclosure is not limited to such application and may be applied to a color printer, a copier, a facsimile machine or a multifunction peripheral.

In the description on the above embodiments, mere examples of the fixing belt and fixing device as well as image forming apparatus according to the present disclosure are stated, and the technical scope of the present disclosure is in no way limited to the above embodiments.

What is claimed is:

1. A fixing belt heated by a heating member in contact with an inner circumferential face through a lubricant while rotating about an axis, the fixing belt comprising: a belt body formed in a tubular shape;

a plurality of oil repellent portions formed on an inner circumferential face of the belt body, each having a surface free energy lower than that of the lubricant to repel the lubricant; and a plurality of oil nonrepellent portions formed on the inner circumferential face of the belt body, each having a surface free energy higher than that of the lubricant to hold the lubricant, wherein the plurality of oil repellent portions and the plurality of oil nonrepellent portions extend in a circumferential direction of the belt body and are alternately arranged in an axial direction of the belt body.

2. The fixing belt according to claim 1, wherein, of the plurality of oil repellent portions, a pair of oil repellent portions are positioned at both axial ends of the inner circumferential face of the belt body.

3. The fixing belt according to claim 1, wherein the plurality of oil repellent portions include a fluororesin, and the plurality of oil nonrepellent portions include a polyimide resin.

4. A fixing device, comprising:

the fixing belt according to claim 1;

a pressurizing member configured to form a pressurizing region between the pressurizing member in itself and the fixing belt while rotating about an axis, and pressurize toner on a medium passing through the pressurizing region; and a heating member configured to come into contact with an inner circumferential face of the fixing belt through a lubricant at a position corresponding to the pressurizing region to heat the fixing belt.

5. An image forming apparatus comprising the fixing device according to claim 4.

6. A fixing belt heated by a heating member in contact with an inner circumferential face through a lubricant while rotating about an axis, the fixing belt comprising:

a belt body formed in a tubular shape;

a plurality of oil repellent portions arranged in a latticed manner at intervals in an axial direction and a circumferential direction of an inner circumferential face of the belt body, and each having a surface free energy lower than that of the lubricant to repel the lubricant; and an oil nonrepellent portion formed on the inner circumferential face of the belt body exclusive of the plurality of oil repellent portions and having a surface free energy higher than that of the lubricant to hold the lubricant.

7. A fixing belt heated by a heating member in contact with an inner circumferential face through a lubricant while rotating about an axis, the fixing belt comprising:

a belt body formed in a tubular shape;

a plurality of oil nonrepellent portions arranged in a latticed manner at intervals in an axial direction and a circumferential direction of an inner circumferential face of the belt body, and each having a surface free energy higher than that of the lubricant to hold the lubricant; and an oil repellent portion formed on the inner circumferential face of the belt body exclusive of the plurality of oil nonrepellent portions and having a surface free energy lower than that of the lubricant to repel the lubricant.

* * * * *